United States Patent [19]

Reinehr et al.

[11] 4,013,406

[45] Mar. 22, 1977

[54] PROCESS FOR CONTINUOUSLY DYEING FILAMENTS OF SLIVERS OF WET-SPUN ACRYLONITRILE POLYMERS

[75] Inventors: Ulrich Reinehr, Dormagen; Hans Lenz, Dormagen-Hackenbroich; Alfred Nogaj, Dormagen; Günter Blankenstein, Stommeln, all of Germany

[73] Assignee: Bayer Aktiengesellschaft, Leverkusen, Germany

[22] Filed: Jan. 14, 1975

[21] Appl. No.: 541,065

[30] Foreign Application Priority Data

Jan. 16, 1974 Germany ..... 2401880

[52] U.S. Cl. ..... 8/17; 8/177 R

[51] Int. Cl.[2] ..... D06P 3/70

[58] Field of Search ..... 8/17, 177 R, 177 AB

[56] References Cited

UNITED STATES PATENTS

| | | | |
|---|---|---|---|
| 3,080,209 | 3/1963 | Fujisaki | 8/177 R |
| 3,093,867 | 6/1963 | Chandler | 8/17 |
| 3,111,357 | 11/1963 | Wirth | 8/177 R |
| 3,113,827 | 12/1963 | Moore | 8/177 R |
| 3,447,887 | 6/1969 | Lindenhovius | 8/177 R |

*Primary Examiner*—Paul R. Michl

*Attorney, Agent, or Firm*—Plumley and Tyner

[57] ABSTRACT

The invention relates to a process for the continuous uniform and penetrative dyeing with high fastnesses of slivers or filaments of acrylonitrile polymers which have been produced by a standard wet-spinning process wherein the slivers or filaments prior to dyeing are subjected to a combined washing, pressing and drying pretreatment.

3 Claims, No Drawings

PROCESS FOR CONTINUOUSLY DYEING FILAMENTS OF SLIVERS OF WET-SPUN ACRYLONITRILE POLYMERS

This invention relates to a continuous dyeing process for producing dyed filaments and slivers of wet-spun acrylonitrile polymers. There are various processes for producing continuously dyed wet-spun acrylic fibres during spinning and stretching. Thus, wet-spun acrylic filaments are dyed after washing and before or after stretching providing they are still in a swollen, undried form (French Pat. No. 980,700; Japanese Pat. No. 24,495; U.S. Pat. No. 3,113,827). Other patents (Czech Pat. No. 104,915; U.S. Pat. No. 3,111,357; British Pat. No. 391,957) describe the dyeing of wet-spun acrylic filaments during stretching, the quantity of dye taken up being greater, the higher the degree of stretching. Wet-spun acrylic fibres can be dyed particularly quickly by directly adding the dye to the coagulation bath, because the dye is able to penetrate immediately into the fibre being formed while its structure is still loose (U.S. Pat. No. 3,242,243 and Czech Pat. No. 95,939). This direct spinning of acrylic fibres into a dye bath is known as "neochrome dyeing" (Manmade Textiles, August 1966, page 58).

One serious problem in the continuous dyeing of spun material is keeping the dye at a constant concentration during the dyeing process. Owing to the moisture content of the slivers or filaments, water is continuously entrained into the dye bath and, hence, the concentration of the dye solution is diluted. This gives rise to irregularities in the dye finish.

Another difficulty in the continuous dyeing of wet-spun acrylic fibres is producing good fastness results. Although, in cases where relatively large proportions of solvent or precipitation-bath liquid are present in the spun material, quick, deep-dye finishes are obtained by diffusion processes, fibres and filaments dyed in this way show a tendency towards heavy "bleeding" during further processing for example during steaming, washing and finishing. Compared with other textiles, fibres dyes in this way show limited resistance to the effects of light, water, perspiration, and to wear and soiling in use. In addition, their resistance to the dyeing processes normally used for polyacrylonitrile fibres (neutral or acetic-acid overdyeing) is greatly reduced.

It has now been found that the disadvantages referred to above do not occur when the material to be dyed is subjected to a combined washing, pressing and drying treatment.

Accordingly it is an object of this invention to provide a process for the continuous uniform and penetrative dyeing of wet-spun acrylonitrile polymers.

It is another object of the invention to provide a process for dyeing acrylonitrile polymers with high fastnesses.

It is another object of this invention to provide a process by which dyeing is achieved very quickly.

Other object will be evident from the following description and the Examples.

These objects are accomplished by a process for the continuous, uniform and penetrative dyeing with high fastnesses of a silver or a filament of an acrylonitrile copolymer which has been produced by a standard wet-spinning process, which comprises subjecting the unstretched filament or sliver before dyeing to a combined washing, pressing and drying pretreatment by washing said filament or sliver once or several times at a temperature of up to 70° C, squeezing it out between squeezing rollers and drying it under the effect of heat, so that the spun material has a residual moisture content of at most 10% by weight and a residual solvent content of at most 4% by weight of the residual moisture content, and thereafter dyeing said filament or sliver in a dye bath over a period of from up to 60 seconds at a temperature in the range of from 20° to 100° C, stretching to between 2.5 and 6.5 times their original length and aftertreating.

Preferably the dyeing is carried out in a period of from 2 to 60 seconds.

Stretching can be carried out either in the dye bath itself or after dyeing.

The spun material is preferably prewashed at room temperature, because treatment of the fibres at boiling temperature would give rise to a pronounced change in the aquagel state, resulting in streaky dye finishes with irregular distribution of the dye throughout the fibre cross-section. Slivers or filaments of defined moisture content are obtained by passing the moist spun material under light tension through one, optionally several tanks filled with water, preferably at room temperature, by way of paired pressure rollers, and then through a pair of squeezing rollers to reduce moisture content, and by subsequently predrying the sliver or bundle of filaments under tension or shrinkage in a dryer equipped with rollers, a screen belt or, optionally, with cylinders, at temperatures in the range of from 80° to 140° C, depending upon the rate of travel and weight of the sliver, so that the residual moisture content of the sliver amounts to approximately 5% and, at most, to less than 10%.

If the moisture content of the unstretched spun material is not reduced to a maximum of less than 10%, as in the process according to the invention, the dye solution is continuously diluted to the point where, ultimately, the dye bath overflows, as shown in Comparison Example 1.

By virtue of a low residual solvent content during the dyeing process, which is obtained by the combined washing, pressing and drying pretreatment of the unstretched spun material in accordance with the invention, it is possible to obtain extremely good fastness results. In contrast, dyed spun material with relatively high solvent contents, for example 25 to 30% of dimethyl formamide, only shows low fastness values and, when squeezed out with water, leaves behind coloured solutions as shown in Comparison Example III.

In the context of the invention, a standard wet-spinning process is one in which the polymers are dissolved in a polar organic solvent and spun into a coagulation bath. Suitable solvents are dimethyl acetamide, dimethyl sulphoxide, ethylene glycol carbonate and dimethyl formamide, this last solvent being particularly preferred.

Filaments or slivers which can be used in accordance with the invention consist of acrylonitrile copolymers containing at least 85% by weight of acrylonitrile and up to 15% by weight of one or more other ethylenically unsaturated comonomers. Comonomers suitable for use in accordance with the invention include, in particular, vinyl esters such as, for example, vinyl acetate, and acrylic and methacrylic acid esters such as, for example, methyl and ethyl acrylate, methyl and ethyl methacrylate, and also those monomers of the kind which contain acid groups, these acid groups always being present in the polymer.

Particularly preferred dyeing additives are allyl sulphonic acid, methallyl sulphonic acid, vinyl sulphonic acid, styrene sulphonic acid, their salts, and also methacroylamino benzene-benzene disulphonimide and mixtures thereof. The process according to the invention can be used with equal effect for filaments and slivers of polymers with a normal acid group context (approximately 60 to 100 m Val/kg of polymer), and for filaments and fibres with a high acid group content (at least 150, preferably 200 to 210 m Val/kg of polymer).

In cases where a polymer with a high acid group content is used as starting material, one advantage of the process according to the invention is that it is possible, without reducing output or without having to resort to additional measures, to obtain ultradeep dye finishes in a continuous dyeing and aftertreatment process. Another advantage lies in the number of new and extremely deep colours, especially in cases where dye mixtures are used, because almost any water soluble basic dye such as, for example, azo, mordant, triphenylmethane and metal complex dyes, can be used for dyeing. In addition, the rapid and complete fixing of the dye prevents the dye from bleeding out during washing, finishing or streaming, something which often happens in practice.

The main advantage of the invention is that uniform, penetrative dye finishes with extremely high fastness values are obtained by a combined pretreatment in a continuous dyeing process.

A few preferred embodiments which are to further illustrate the process according to the invention without limiting it are described in the following Examples. The fastness values quoted in the Examples were determined as follows (Literature: "Farbechtheitsnormen" (Colour-Fastness Standards), Taschenbuch 16 of the German Standards Institute, Beuth-Vertrieb GmbH, Berlin 30 (1966):

1. Determining fastness to light in accordance with DIN 54004, pages 68 to 72.
2. Determining fastness to washing (40° C wash) in accordance with DIN 54014, pages 88 to 89.
3. Determining fastness to perspiration in accordance with DIN 54020, pages 96 to 97.
4. Determining fastness to rubbing (dry and wet) in accordance with DIN 54021, page 98.
5. Determining fastness to overdyeing in accordance with DIN 54049, pages 139 to 140.
6. Determining the quantity of dye on the dyed fibre: 5 ml of a solution of 20g/l of the dye mentioned in Example 1 are pipetted off and diluted to 1 liter. The extinction value in a 1 cm cell at a wavelength of 590 mμ amounts to 2.1 (extinction maximum).

Conversion: 100 mg of dye per liter of solution = 2.1. Accordingly, a measured extinction of 1.91 for 100 mg of fibre per 100 ml corresponds to approximately 90.9 mg of dye per g of fibre.

EXAMPLE 1

An acrylonitrile copolymer of 9.14 % of acrylonitrile, 5.2 % of methyl acrylate and 3.4 % of sodium methallyl sulphonate was dissolved in DMF to form a 24.0 % solution, which was spun into a spinning bath consisting of 50 % of DMF and 50 % of $H_2O$. The temperature of the precipitation bath was 7° C and the take-off rate was 10 meters per minute. In order to remove the solvent, the sliver with a total denier of 1,062,000 dtex, was passed through a tank filled with water at room temperature. A pair of pressure rolls was mounted at the inlet and outlet ends of the tank. Thereafter, the moist, parallelised sliver, which was about 170 to 180 mm wide, was squeezed off through a pair of pressure rolls and guided under tension through a a dryer. The temperature prevailing inside the dryer was regulated according to the rate of travel of the sliver in such a way that the sliver left the dryer with a residual moisture content of approximately 5%. For example, a residual moisture content of 5.9% was obtained with a 16 meters long sliver with the overall denier mentioned above travelling at a rate of 10 meters per minute at a maximum dryer temperature of 135° C. Of this 5.9% residual moisture, 3.6% were contributed by residual solvent (dimethyl formamide). Thereafter, the sliver was dyed at boiling temperature in a dye bath and, at the same time, stretched to 5 times its original length. The sliver was dyed with a dye corresponding to the formula.

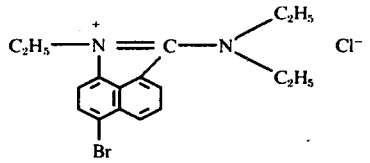

(a)

in a concentration of 30 g per liter. The residence time in the dye bath was 30 seconds. The dyed sliver was then fixed under saturated steam conditions at 105° C in a festoon-type steamer. The residence time in the steamer was approximately 2 minutes. The fixed, dyed tow was then washed and finished. The washing and finishing tank did not show any signs of discoloration. The dye had been completely fixed in the dye bath. The dyed sliver was then subjected to dry shrinkage treatment in a dryer with 14 perforated cylinders. Shrinkage was carried out in stages to levels of 15% and 5%, so that the tow left the dryer fully shrunk. The rate of travel of the tow was 50 meters per minute and its residence time was approximately 60 seconds. The temperature prevailing inside the dryer was between 130° and 140° C. The dyed tow was then crimped and canned. Yarns with a denier of 3.1 dtex produced from the dyed sliver had a boiling-induced shrinkage of 1.7%, a tensile strength (g) of 7.4 and an elongation at break of 26 %. Fibre cross-section: deep blue-black in color throughout; dye uptake (mg/g of fibre): 202.0; extinction: 4.25 (100 mg of fibre/100 ml of DMF); fastnesses: fastness to light: 5 – 6; fastness to washing and perspiration 5; fastness to wet rubbing 4; fastness to dry rubbing 4 – 5; fastness to overdyeing: bleeding against PAN neutral and acetic acid 2 – 3; milliequivalents of acid groups per kg of polymer 211.

EXAMPLE 2

A sliver of an acrylonitrile copolymer with the same composition as in Example 1 was pretreated in the same way and dyed in a vat at room temperature. The residence time was 30 seconds. Thereafter the dyed tow was fixed with saturated steam, stretched to 5 times its original length in boiling water, washed and finished, and then dried in a dryer at 130° C with 20% shrinkage, crimped and charted. The tow was dyed with a dye mixture of 16.5 g/l of a dye (b) corresponding to the formula (b)

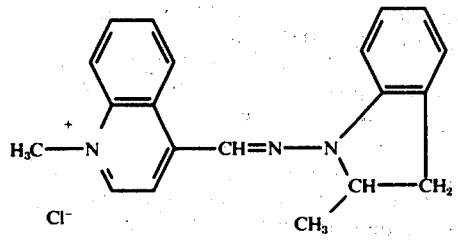

and 1.65 g/l of dye (a) from Example 1, in order to obtain an aubergine colour finish. Yarns produced from the dye tow (individual fibre denier 3.8 dtex) had a boiling-induced shrinkage of 4.8 %, a tensile strength (g) of 7.8 and an elongation at break of 26 %. Fibre cross-section: dyed throughout; dye uptake (mg/g of fibre) 128; extinction 2.28 (100 mg of fibre/100 ml of DMF).

Determining the quantity of dye on the dyed fibre: 1 ml of a solution of 25 g/l of dye (b) and 2.5 g/l of dye (a) was pipetted off and diluted to 1 liter. The extinction in a 1 cm cell measured at a wavelength of 500 mμ amounted to 0.491. Conversation: 100 mg of dye per liter of solution = 1.785. Fastnesses: fastness to light 5 – 6; fastness to washing and perspiration 5; fastness to wet rubbing 4; fastness to dry rubbing 4 – 5; fastness to overdyeing: bleeding against polyacrylonitrile neutral and acetic acid 2.

EXAMPLE 3

A sliver of an acrylonitrile copolymer with the same composition as in Example 1 was prewashed in the same way, squeezed out and then passed under tension through a dryer with 10 perforated cylinders. The drying temperature was adjusted according to the rate of travel of the sliver in such a way that the sliver left the dryer with a residual moisture content of approximately 5 to 8%. For example, the dryer temperature amounted to 100° C for a 150 mm wide sliver with an overall denier of 1,062,000 dtex travelling at a rate of 20 meters per minute. The sliver was then dyed in a dip tank containing 30 g/l of a dye corresponding to the formula

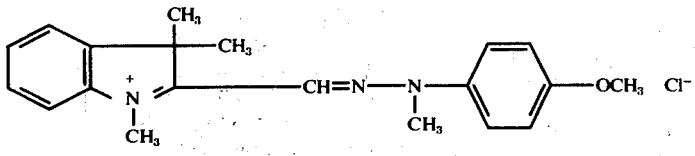

at room temperature in order to obtain a yellow color finish. The residence time in the dye bath was 3 to 4 seconds. The rate of travel of the sliver through the dye bath was 14 meters per minute. Thereafter, the sliver was fixed under saturated steam conditions, stretched to 5 times its original length in boiling water, washed and finished, and then dried in a dryer at 130° C with 20% shrinkage. The dyed sliver was then crimped and canned. Yarns with a denier of 3.3 dtex produced from the dyed silver had a boiling-induced shrinkage of 3.7%, a tensile strength (g) of 7.5 and an elongation at break of 26%. The fibre cross-section was coloured deep golden yellow throughout. Dye uptake (mg/g of fibre) 33.7; extinction 0.816 (100 mg of fibre/100 ml of DMF). Determining the quantity of dye on the dyed fibre: extinction was measured from a solution of 100 mg/l of the above-mentioned dye in a 1 cm cell at a wavelength of 440 mμ, and amounted to 2.06. Fastnesses: fastness to light 7, fastness to washing and perspiration 5; fastness to wet rubbing 4 – 5; fastness to dry rubbing 5; fastness to overdyeing: bleeding against PAN neutral and acetic acid 2.

EXAMPLE 4

An acrylonitrile copolymer of 93.6 % of acrylonitrile, 5.7% of methyl acrylate, 0.4 % of methacroylamino benzene - benzene disulphonimide and 0.3% sodium methallyl sulphonate was wet-spun in the same way as described in Example 1. To remove the solvent, the sliver with a total denier of 1,210,000 dtex, which still contained 138% of dimethyl formamide, based on dry sliver, was passed through 3 tanks filled with water at room temperature. Each tank was fitted with a pair of squeezing rollers at its inlet and outlet ends. The tow was then squeezed out through another pair of pressure rollers and, with a moisture content of 28.5% was predried under tension in a dryer at a maximum temperature of 130° C. The rate of travel was 10 meters per minute, and the residence time in the dryer was 1.5 minutes. The tow treated in this way still had a residual moisture content of 5.8 % of which 3.4 % were contributed by residual solvent. The tow was then dyed at 80° C with 20 g/l of the dye from Example 1. The residence time in the dye bath was 9 to 10 seconds. The dye tow was then fixed under saturated steam conditions in a festoon-type steamer, stretched to 5 times its original length in boiling water, washed, finished and dried in a dryer with 20% shrinkage at a maximum dryer temperature of 130° to 140° C, crimped and canned. Yarns with a denier of 3.1 dtex produced from the dyed sliver had a boiling-induced shrinkage of 1.5% a tensile strength (g) of 7.3 and an elongation at break of 26%. Fibre cross-section: colored blue throughout. Dye uptake (mg/g of fibre) 24.1, extinction 0.505 (100 mg of fibre/100 ml of DMF). Fastnesses: fastness to light 5 – 6; fastness to washing and perspiration 4 – 5; fastness to wet rubing 4 – 5; fastness to dry rubbing 5; fastness to overdyeing: bleeding against polyacrylonitrile neutral and acetic acid 2 – 3; milliequivalents of acid groups per kg of polymer 80.

EXAMPLE 5

A sliver of an acrylonitrile copolymer with the same composition as in Example 4 was prewashed in water at room temperature, squeezed out and predried in a dryer with 10 perforated cylinders at a maximum temperature of 140° C. The residual moisture content was 6.8%. The sliver was then dyed in a dip tank at room temperature with 30 g/l of the dye from Example 3. The residence time in the dip tank was 3 to 4 seconds. The rate of sliver travel was 14 meters per minute. The sliver was then fixed in a festoon-type steam under saturated steam conditions, stretched to 5 times its original length in boiling water, washed, finished and dried in a dryer at 130° C with 20% shrinkage. The dyed tow was crimped and canned. Yarns with a denier of 3.3 dtex produced from it had a boiling-induced shrinkage of 4.4% a tensile strength (g) of 7.4 and an elongation at break of 26%. Fibre cross-section: coloured yellow throughout. Dye uptake (mg/g of fibre) 24.9; extinction 0.474 (100 mg of fibre/100 ml of DMF). For determination of the quantity of dye on the dyed fibre see Example 3. Fastnesses: as in Example 3; milliequivalents of acid groups per kg of polymer 80.

COMPARISON EXAMPLE I

An acrylonitrile polymer with the same composition as in Example 1 was wet-spun. The sliver was gathered together to form a tow with a total denier of 1,062,000 dtex, passed through a tank containing water at room temperature and then squeezed out between a pair of pressure rollers (residual moisture content 31.5%). Without being predried, the tow was dyed in a dip tank at room temperature with 20 g/l of the dye from Example 1. The rate of travel of the tow was 10 meters per minute. The tow was then fixed with saturated steam, stretched to 5 times its original length in boiling water, washed, finished and dried in a dryer at 140° C with 20% shrinkage. During dyeing, the level of liquid in the dip tank rose steadily and, ultimately, overflowed after about 50 minutes. At the same time, the dyed tow showed signs of non-uniform dyeing. The dye solution was continuously diluted by the moisture entrained into it, and produced lighter dye finishes in the tow.

Fibre cross-section: colored throughout but irregular in color, some light blue, some dark blue circular to bean-like cross-sections.

COMPARISON EXAMPLE II

A sliver obtained by wet spinning process described in Example 1 from an acrylonitrile polymer with the same composition as in Example 1, was passed under tension through 3 rows of tanks filled with boiling water arranged in pairs one behind the other, subsequently squeezed out between a pair of pressure rollers and predried under tension at a maximum temperature of 140° C. The residual solvent content still amounted to 0.7% of dimethylformamide for a total moisture content of 3.8 %. The sliver was then vat-dyed at boiling temperature with 30 g/l of the dye from Example 1. The residence time in the dye bath was 30 seconds. The dyed sliver was then fixed under saturated steam conditions in a festoon-type steamer. The fixing time was 2 minutes. The dyed tow was stretched to 5 times its original length in boiling water, washed, finished and dried under 20% shrinkage at a maximum dryer temperature of 130° C, crimped and canned in the form of a continuous tow. The tow had a streaky dye finish. Fibre cross-section: colored throughout in some places, some light and undyed circular and bean-like cross-sections. Dye take-up (mg/g of fibre) 37.4 (light fibres); 201.0 (dark fibres); extinction (100 mg of fibre/100 ml of DMF) 0.822 (light fibres); 4.24 (dark fibres). As a result of the heavy thermal stressing of the spun material in boiling water, some of the aqua-gel conditions was lost with the result that, after dyeing, the tow showed a streaky dye finish.

COMPARISON EXAMPLE III

An acrylonitrile copolymer with the same composition as in Example 1 was wet spun. The sliver with a total denier of 1,210,000 dtex still contained 117% of dimethylformamide based on dry sliver. The sliver was prewashed with water at room temperature in a tank and squeezed out between a pair of pressure rollers. The residual solvent content still amounted to 28.2%. Without further predrying, the sliver was dyed in a dip tank at room temperature with 30 g/l of the dye from Example 1. Residence time in the dye solution: 3 – 4 seconds. The tow was then fixed under saturated steam conditions, stretched to 5 times its original length in boiling water, washed, finished and dried under 20% shrinkage at a maximum dryer temperature of 140° C. The tow was then crimped and charted. Fibre cross-section: coloured throughout. Dye uptake (mg/g of fibre) 16.5. Extinction 0.345 (100 mg of fibre/100 ml of DMF. Fastnesses: fastness to light 2 – 3; fastness to washing and perspiration 4 – 5; fastness to wet rubbing 3; fastness to dry rubbing 4; fastness to overdyeing: bleeding against polyacrylonitrile neutral and acetic acid 1 – 2. A sample of the dyed fibre bled when squeezed out in cold water.

COMPARISON EXAMPLE IV

An acrylonitrile copolymer with the same composition as in Example 4 and containing 80 milliequivalents of acid group per kg of polymer, was wet spun. The sliver with a total denier of 404,000 dtex still contained 120% of dimethylformamide. The sliver was prewashed with water at room temperature in a tank, and squeezed out between a pair of pressure rollers. The residual solvent content then amounted to 29.4%. Without further predrying, the sliver was dyed in a dip tank at room temperature with 30 g/l of the dye from Example 1. Residence time in the dye solution: 3 – 4 seconds. The tow was then fixed under saturated steam conditions, stretched to 5 times its original length in boiling water, washed, finished and dried under 20% shrinkage at a maximum dryer temperature of 130° C. The tow was then crimped and canned. Fibre cross-section: coloured throughout; dye uptake (mg/g of fibre) 10.4; extinction 0.219 (100 mg of fibre/100 ml of DMF); fastnesses: fastness to light approximately 3; fastness to washing and perspiration 4 – 5; fastness to wet rubbing 2; fastness to dry rubbing 4; fastness to overdyeing: bleeding against polyacrylonitrile neutral and acetic acid 1.

We claim:

1. A process for the continuous, uniform and penetrative dyeing with high fastnesses of a sliver or a filament of an acrylonitrile copolymer which has been produced by a standard wet-spinning process, which comprises subjecting the unstretched filament or sliver before dyeing to a combined washing, pressing and drying pretreatment by washing said filament or sliver once or several times at a temperature of up to 70° C, squeezing it out between squeezing rollers and drying it under the effect of heat, so that the spun material has a residual moisture content of at most 10% by weight and a residual solvent content of at most 4% by weight of the residual moisture content, and thereafter dyeing said filament or sliver in a dye bath over a period of from up to 60 seconds at a temperature in the range of from 20° to 100° C, stretching to between 2.5 and 6.5 times their original length and aftertreating.

2. The process of claim 1, wherein said stretching is carried out in the dye bath.

3. The process of claims 1 and 2, wherein said acrylonitrile copolymer contains at least 150 milliequivalents of acid groups per kg of polymer.

* * * * *